US005899815A

United States Patent [19]

Helou et al.

[11] Patent Number: 5,899,815

[45] Date of Patent: May 4, 1999

[54] ENHANCEMENT OF A BOWLING GAME

[75] Inventors: Marcel Helou, Caldwell, N.J.; Paul J. Swers, Northport; W. Hubert Plummer, Port Washington, both of N.Y.

[73] Assignee: Skillball, Inc., Hauppague, N.Y.

[21] Appl. No.: 08/910,283

[22] Filed: Aug. 13, 1997

[51] Int. Cl.[6] ..... A63F 3/06

[52] U.S. Cl. ..... 473/54; 273/269

[58] Field of Search ..... 473/54, 65, 70; 273/139, 269, 270, 277

[56] References Cited

U.S. PATENT DOCUMENTS

| | | | |
|---|---|---|---|
| 4,225,924 | 9/1980 | Trujillo | 473/65 |
| 5,437,575 | 8/1995 | Douglass, Jr. | 473/54 |
| 5,577,971 | 11/1996 | File | 473/54 |

*Primary Examiner*—William M. Pierce
*Attorney, Agent, or Firm*—Bauer & Schaffer, LLP

[57] ABSTRACT

A skill based game presented in a bingo format in which a bowler, based on his or her bowling skill level and number of strike frames bowled during a three game session, has an opportunity to successfully complete pre-identified bingo patterns for awards. All entrants pay a fee prior to their league bowling and receive one or more computer generated bingo cards, each containing a matrix of numbers that correspond to individual bowling frame numbers for their three game sessions. In addition, and as a means of equalizing opportunity (handicapping bowlers), free computer generated strike frames may be given on each entrant's bingo card based on the bowlers skill level. An algorithm has been developed which determines the number of free strikes awarded to equalize all skill levels. The number of free strikes given is determined by identified average bracket levels and the system precludes issuance of a winning pattern with free spaces. The game is played and won when a bowler matches the frame numbers in which they strike with the frame numbers identified on their bingo cards, and combined with any free spaces, match any of a variety of the winning pre-identified bingo patterns. Bowler's strike accomplishments are retrieved from the automatic scoring systems at the bowling centers and used as input into the game's software system.

27 Claims, 16 Drawing Sheets

| | | | | | |
|---|---|---|---|---|---|
| 119 | AVERAGE OR LESS | - - - - - - - - | 12 | FREE | POSITIONS / BOXES |
| 120 - 139 | AVERAGE | - - - - - - - - | 10 | " | " " |
| 140 - 159 | AVERAGE | - - - - - - - - | 8 | " | " " |
| 160 - 179 | AVERAGE | - - - - - - - - | 5 | " | " " |
| 180 - 195 | AVERAGE | - - - - - - - - | 2 | " | " " |
| 196 + | AVERAGE | - - - - - - - - | 0 | " | " " |

FIG. 3

ENHANCEMENT OF A BOWLING GAME

BACKGROUND OF THE INVENTION

The present invention relates to a bowling game. More particularly, the present invention relates to a game method for enhancing the entertainment of a traditional bowling game.

The standard rules of bowling have remained fairly consistent over time and have turned the game into what is predominantly one of skill opposed to a game of chance.

Although the inexperienced bowler may on occasion enjoy a spare or a strike, the highest scores in the game are generally only achieved by those who have obtained a high level of skill. While this fact does not altogether discourage the inexperience bowler from participating in the sport, it does confine the inexperience bowler to competing against those that are at the same skill level.

The basic rules of bowling consist of bowlers engaging in what are essentially two-ball frames for a sequence of ten frames to arrive at a final score that is compared with other bowlers who bowl at the same time. In most cases, the bowlers who are competing against each other are in adjacent bowling lanes in the same bowling establishment. A perfect score, according to the standard rules of bowling, is 300 and involves a strike on each of twelve tries with the bowling ball in the same game.

Each frame is nominally associated with the rolling of a first and then a second ball by each bowler. If the first ball is a strike, no second ball is thrown. A bowler may, therefore, throw as many as twenty-one balls during a complete game, or as few as twelve. In any event, scoring is accomplished by adding the number of pins knocked down in each frame to the total previously accumulated in earlier frames. Spares involve a total of ten plus the sum of the next ball thrown, and strikes involve a total of ten plus the sum of the next two balls thrown. In every case, the goal is to knock down as many pins as possible with each ball thrown. The skills, therefore, involve appropriate targeting and placement of the ball when thrown, such that the maximum number of pins are knocked down.

Some modifications of the apparatus associated with the play of a standard game of bowling have been implemented and have allowed the less experienced bowler to compete more directly with those whose skill levels are higher. For example, there are bowling systems and methods that incorporate bumpers in a manner that may alter the scoring procedure during a game of bowling.

These bumper bowling systems and methods permit inexperienced players to acquire new skills at the same time, or at an advanced rate, over those already skilled at the standard rules of bowling. Some aspects of these bumper bowling systems also permit random factors to enter into the final score in any frame and thus, in any particular game of bowling.

Despite this, it would be desirable to incorporate additional elements of handicapping into the play of bowling, such that unskilled players might compete more directly against those skilled in the game.

Two games commonly associated with randomness and chance, as opposed to skill, are bingo and lottery. Lottery games generally involve the random selection of some set of numbers that may or may not be matched by those who participate in the game. The typical lottery game might involve a set of six numbers, each number having a value from 1–50, with no two of the numbers being the same.

Participants in the lottery game guess and select six such numbers prior to some random number generating device selecting the six numbers. Many state lotteries are based upon a system such as this.

Bingo is in many respects a more complex type of lottery game in that participants utilize a card with a random arrangement of numbers selected from the number group 1–75, organized in a two-dimensional matrix, typically 5 by 5. Individual numbers are then randomly selected and identified on each player's card matrix. The first player to acquire a specific pattern of matched numbers on his or her card is declared the winner.

It would be desirable to incorporate some of the random aspects of the game of bingo into the game of bowling in a manner that would permit unskilled bowlers to compete against those more skilled in the field.

Numerous innovations for bowling entertaining enhancement games have been provided in the prior art that will be described. Even though these innovations may be suitable for the specific individual purposes to which they address, however, they differ from the present invention.

For example, U.S. Pat. No. 5,437,575 to Douglass, Jr. teaches a game method utilizing a particular number of bowling pins that are set up in a formation which may be conventional to bowling. A bowling ball is directed at the bowling pins in order to topple the same. The toppled bowling pins are transferred into a number which is indicated on a game board having a number of spaces, each with an assigned number. The spaces on the game board are arranged in a definite pattern. Successive placements of indica on the game board are collated according to an arrangement forming a selected part of the game board pattern.

Another example, U.S. Pat. No. 5,577,971 to J. File teaches a game method of play combining the skill elements of bowling with the chance elements of bingo and lottery. The game method of play includes the steps of randomly arranging and displaying a set of numbers in an order in which the numbers are to be picked for the purposes of separately identifying a lottery-type arrangement or a bingo-type arrangement. The game further involves a number of bowlers participating in a sequence of bowling frames such that the scores in the bowling frames are compared with the randomly arranged numbers previously displayed. As the randomly arranged numbers are sequentially stepped through in the comparison process, orderly patterns of matched scores and numbers are detected and identified as winning arrangements, when acquired. Various sets of specific numbers, such as in a lottery game, or various orderly patterns, such as those typically found in bingo, may be utilized to identify the winner of a particular game.

It is apparent that numerous innovations for bowling entertaining enhancement games have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

Accordingly, an object of the present invention is to provide a game method for enhancing the entertainment of a traditional bowling game that avoids the disadvantages of the prior art.

The present invention was developed by a company called Skillball, Inc, a company organized and resident in New York to provide computer technology to the entertainment industry, and in particular, to the sport of bowling.

One of its first undertakings was to develop software for security and audit accountability for the traditional strike bowling competition/tournament. This competition, generally known as the "Strike-It-Rich" competition, is usually based on a challenge of 12 or 13 strikes in designated bowling frames within a three game league session. These strike arrangements are clearly identified to all bowlers prior to league play. Participants pay an entry fee to be included in the competition and the posted prize increases each week the challenge is not won.

In computerizing the competition, Skillball, Inc. provided a real time monitoring of bowling scores as recorded on the bowling establishments automatic scoring equipment and provided a secure audit record on all participation fees and winners. The "Strike-It-Rich" challenge has been recognized as a skill competition for many years, but limited in its appeal to highly skilled bowlers.

In the course of developing the monitoring software and system for the "Strike-It-Rich" challenge, Skillball, Inc. was solicited by the bowling industry to develop a competition which would provide a skill challenge open to all skill levels of bowlers. After extensive research, Skillball, Inc. developed a skill competition that meets that objective.

The competition designated at this time as "Strike Bingo" is based on a proprietary algorithm which creates a challenge based on the bowler's certified average (skill level) which effectively equalizes all skill levels to provide equal opportunity. The competition has been extensively tested to verify the equality of opportunity and has been endorsed by all test participants as an entertainment enhancement to traditional bowling that is expected to generate new appeal in a sport already enjoying a revival of public interest.

Winners are determined exclusively on the basis of the ability of the participant to bowl strikes in the challenge bowling frames. The proprietary algorithm used to create the challenge matrix is programmed to preclude the creation of a winner on the basis of "free" positions only. Skill is the sole determinative of winning. Under the equalization of opportunity which makes the competition unique, a 196 bowler would have to bowl 5 strikes to complete a winning diagonal, while a 119 bowler may only have to bowl 1 strike to complete a winning diagonal. That differential represents the equalization based on certified skill level. This has been verified through extensive testing prior to live operation.

Another object of the present invention is to provide a game method for enhancing the entertainment of a traditional bowling game that is simple and inexpensive to manufacture.

Still another object of the present invention is to provide a game method for enhancing the entertainment of a traditional bowling game that is simple to use.

Briefly stated, yet another object of the present invention is to provide a skill based game presented in a bingo format in which a bowler, based on his or her bowling skill level and number of strike frames bowled during a three game session, has an opportunity to successfully complete pre-identified bingo patterns for awards. All entrants pay a fee prior to their league bowling and receive one or more computer generated bingo cards, each containing a matrix of numbers that correspond to individual bowling frame numbers for their three game sessions. In addition, and as a means of equalizing opportunity (handicapping bowlers), free computer generated strike frames may be given on each entrant's bingo card based on the bowlers skill level. An algorithm has been developed which determines the number of free strikes awarded to equalize all skill levels. The number of free strikes given is determined by identified average bracket levels. The game is played and won when a bowler matches the frame numbers in which they strike with the frame numbers identified on their bingo cards, and combined with any free spaces, depending on their bowling average, match any of a variety of the winning pre-identified bingo patterns. Bowler's strike accomplishments are retrieved from the automatic scoring systems at the bowling centers and used as input into the game's software system.

The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWINGS

In the drawings:

FIG. 3 is a table summarizing the results of FIG. 2;

DETAILED DESCRIPTION OF THE PREFERRED EMBODIMENT

Figure 1A:
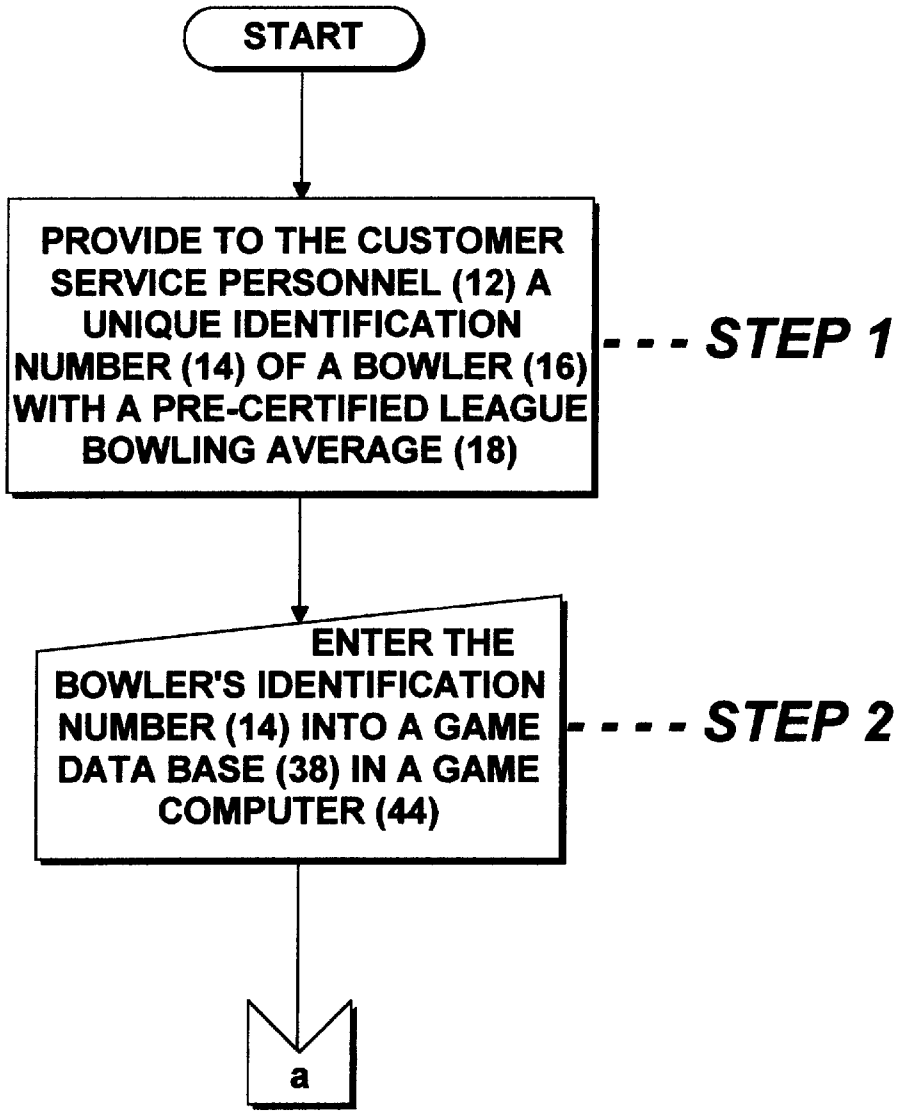
FIGS. 1A–1H are a process flow chart for carrying out the game method of the present invention.
Figure 1B:
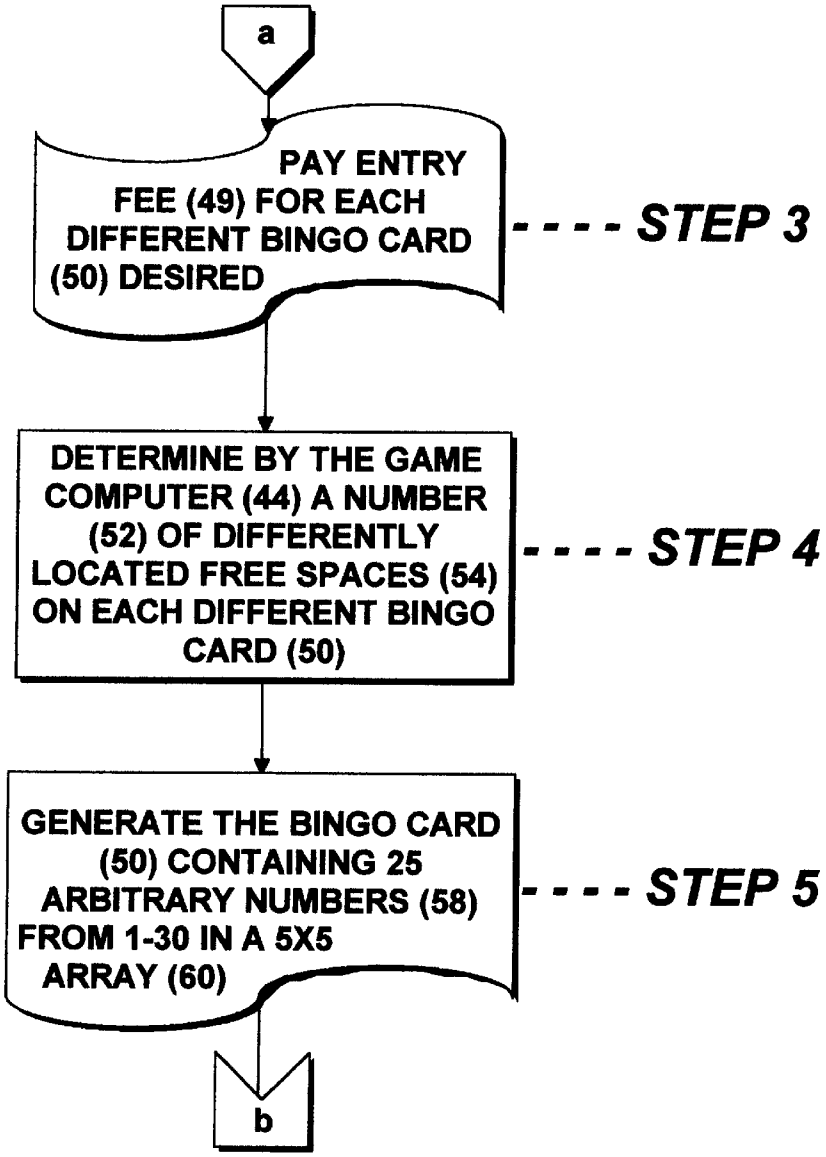
Figure 1C:
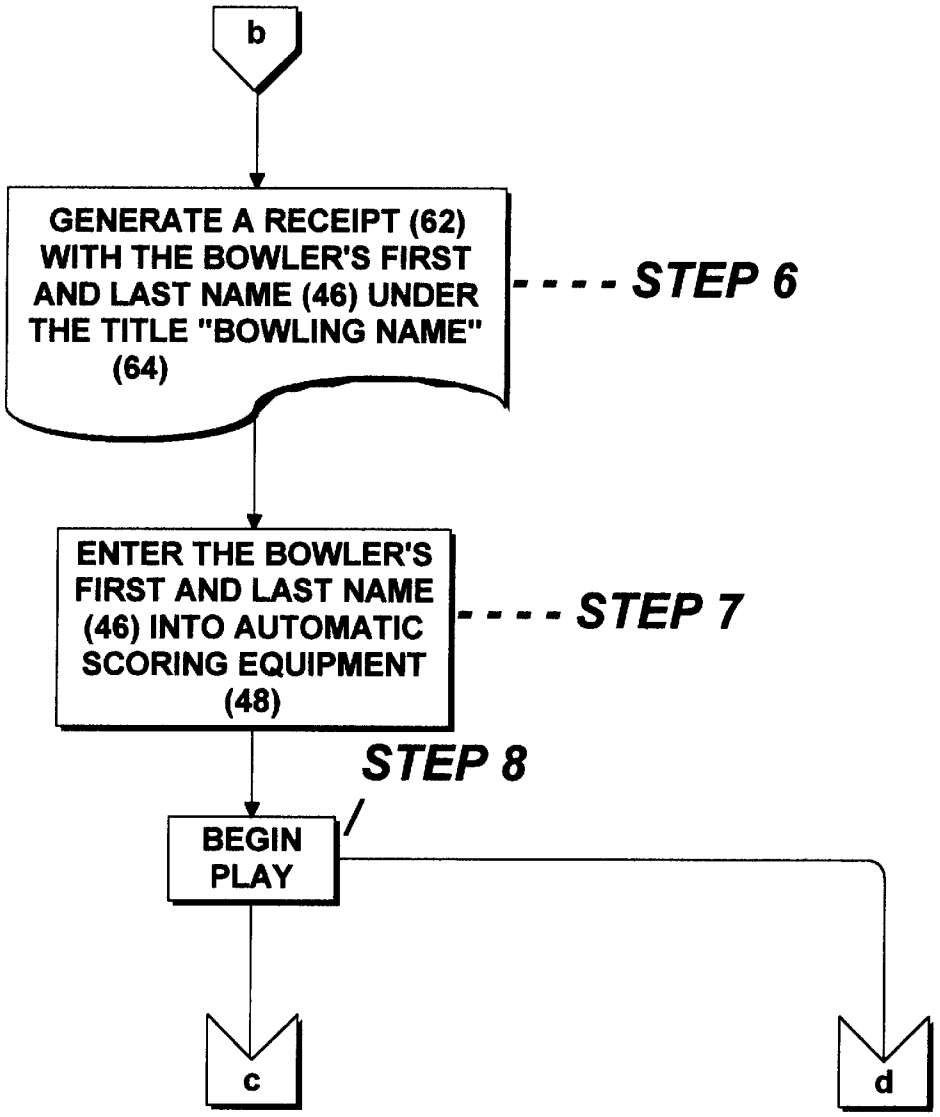
Figure 1D:
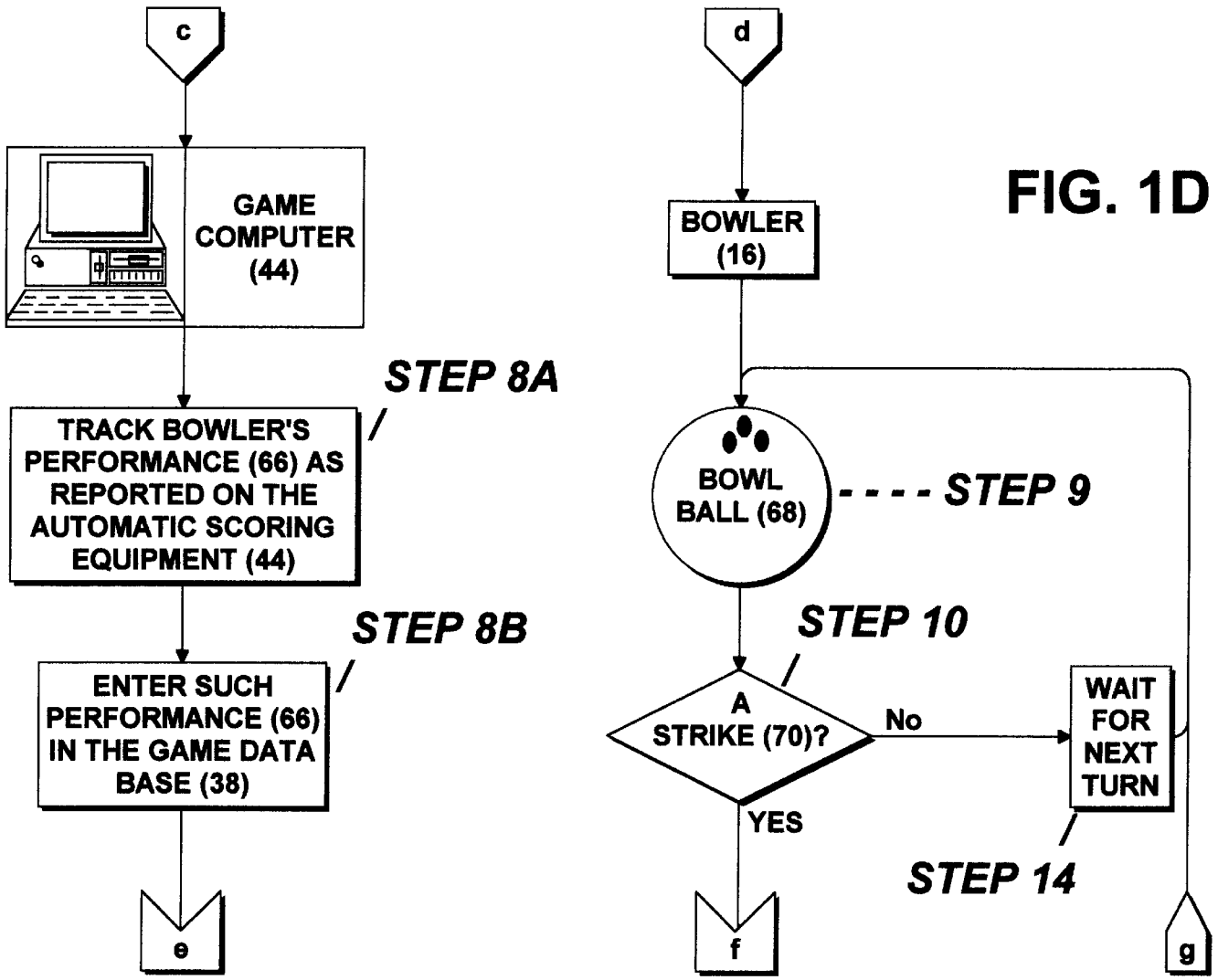
Figure 1E:
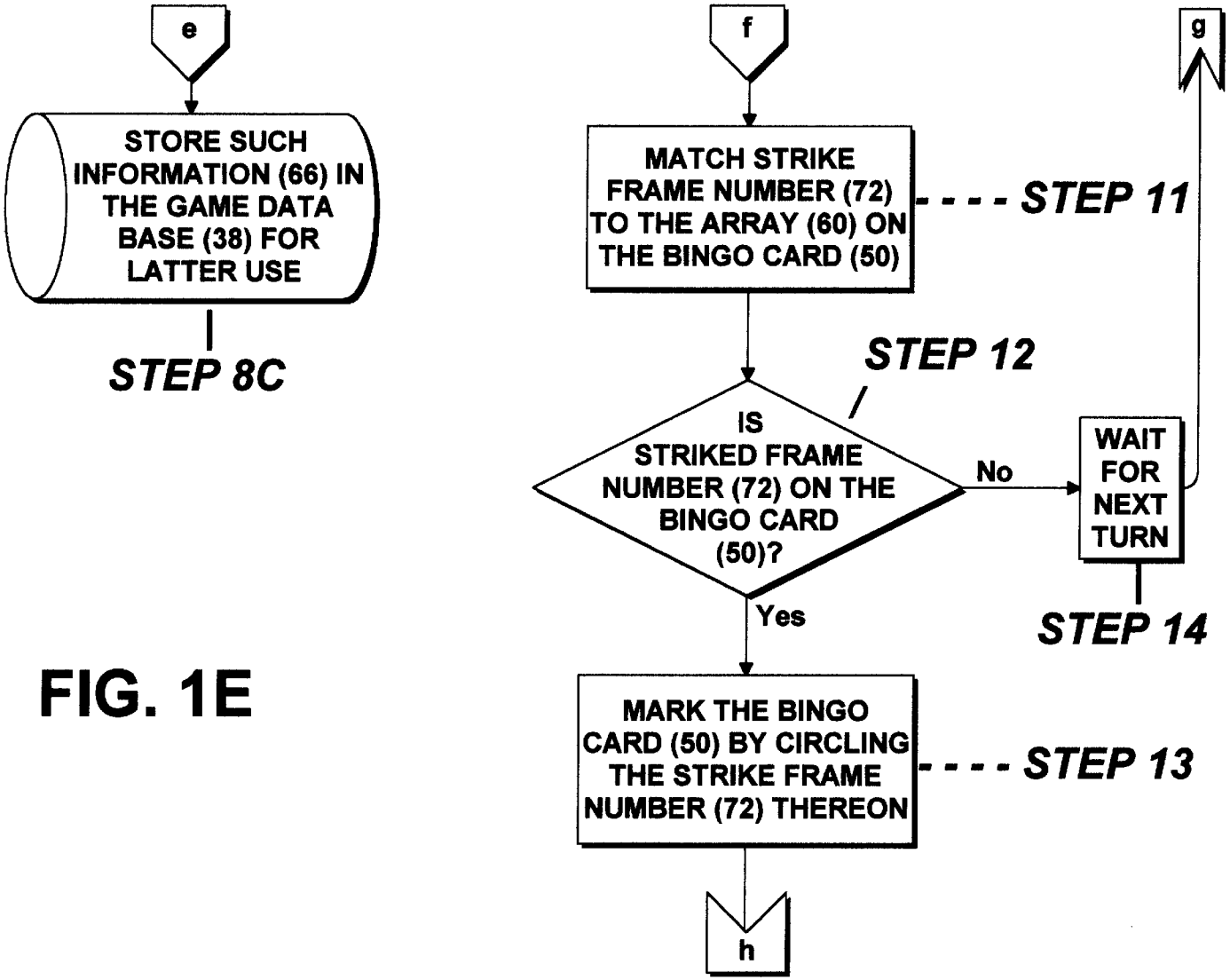
Figure 1F:
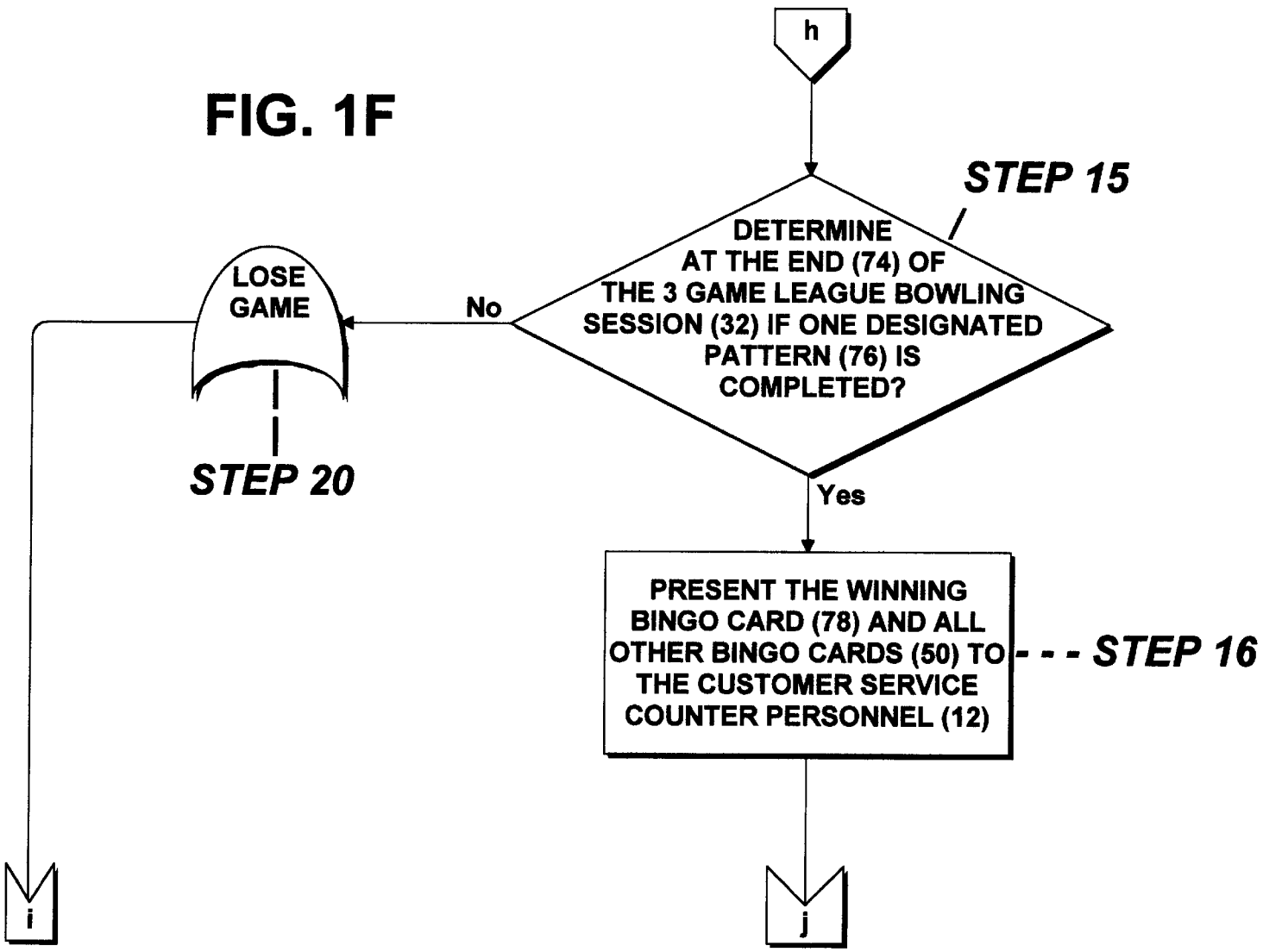
Figure 1G:
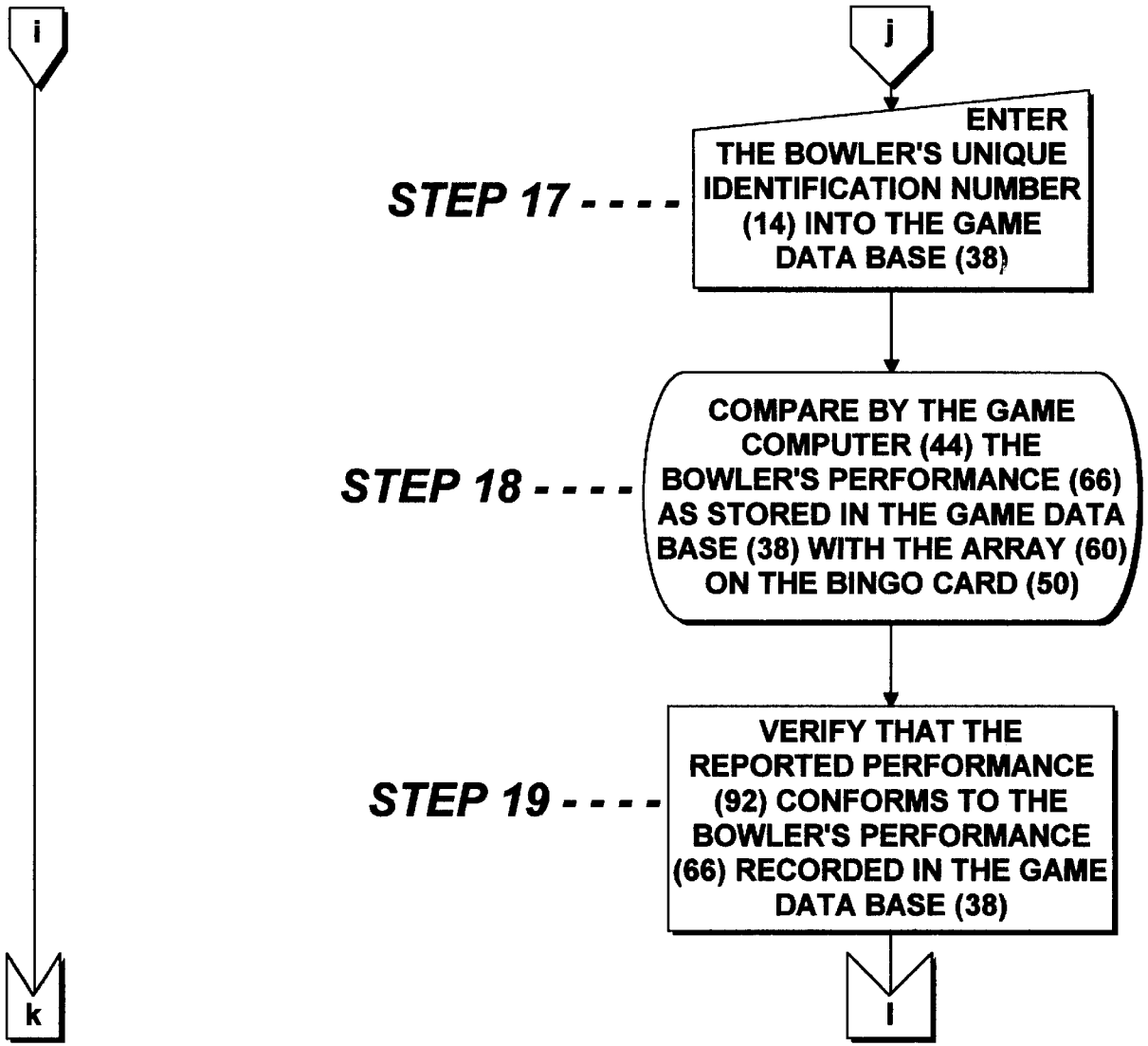
Figure 1H:
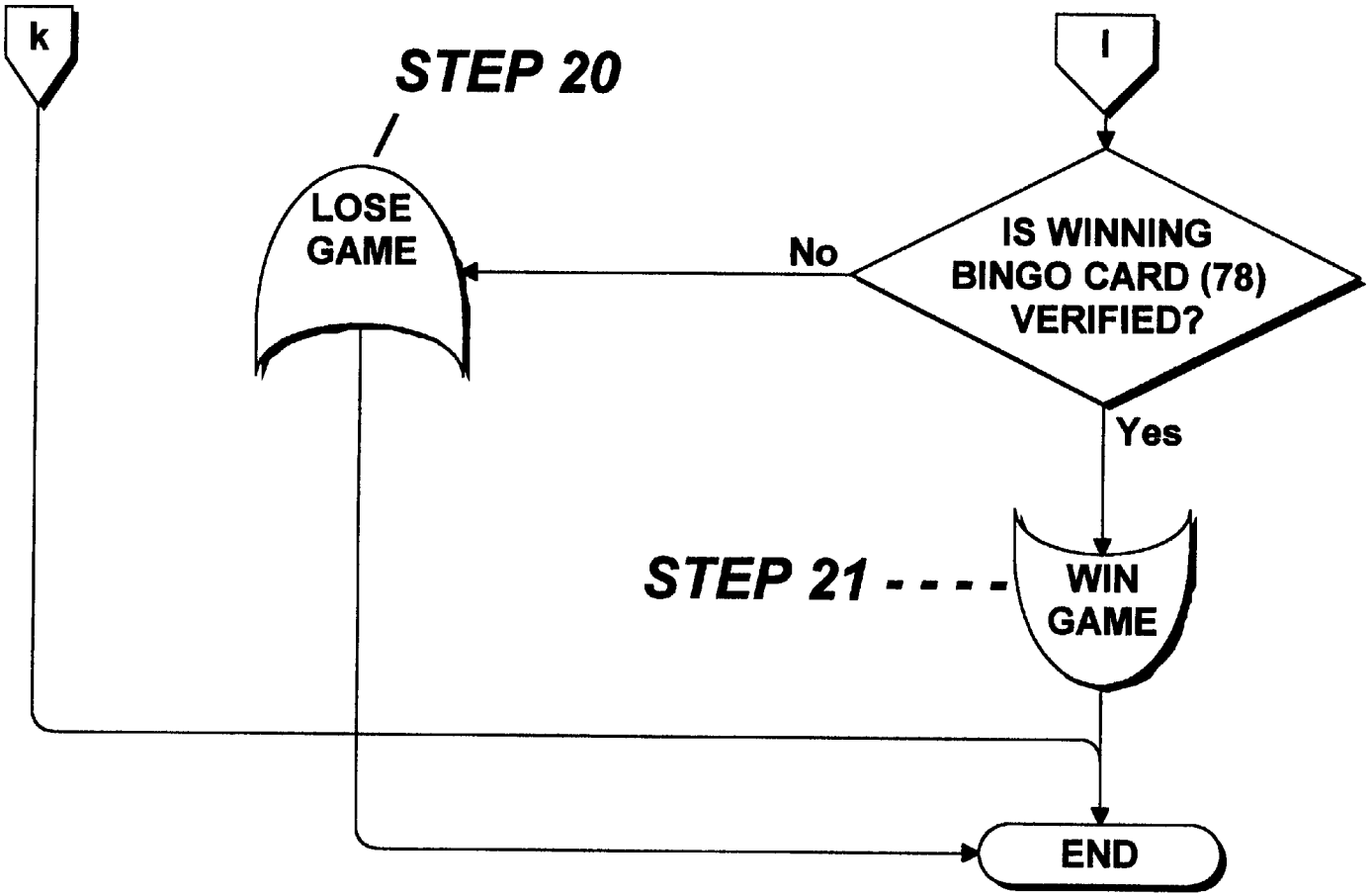

Referring now to the figures in which like numerals indicate like parts, and particularly to FIGS. 1A–1H, the game method for enhancing the entertainment of a traditional bowling game of the present invention is shown generally at 10 and includes the following steps, preferably in the order given:

STEP 1

Provide to the customer service counter personnel 12 a unique identification number 14 of a bowler 16 with a pre-certified league bowling average 18.

The unique identification number 14 of the bowler 16 comprises bowler initials 24, the last four digits 26 of the bowler's phone number 28, and as a separate requirement for registration, the assigned lane 30 for a three game league bowling session 32.

The pre-certified league bowling average 18 of the bowler 16 is calculated as the higher of last year's highest bowling average 34, with a minimum of 21 games, or the current year's highest league average 20 of all leagues 22, with a minimum of 21 games. A bowler with no established average will participate at the most difficult average level until a certified league average is established.

STEP 2

Enter the bowler's unique identification number 14 into a game data base 38 in a game computer 44.

STEP 3

Pay entry fee 49 for each different bingo card 50 desired, with a maximum of 5 bingo cards 50.

STEP 4

Figure 2:
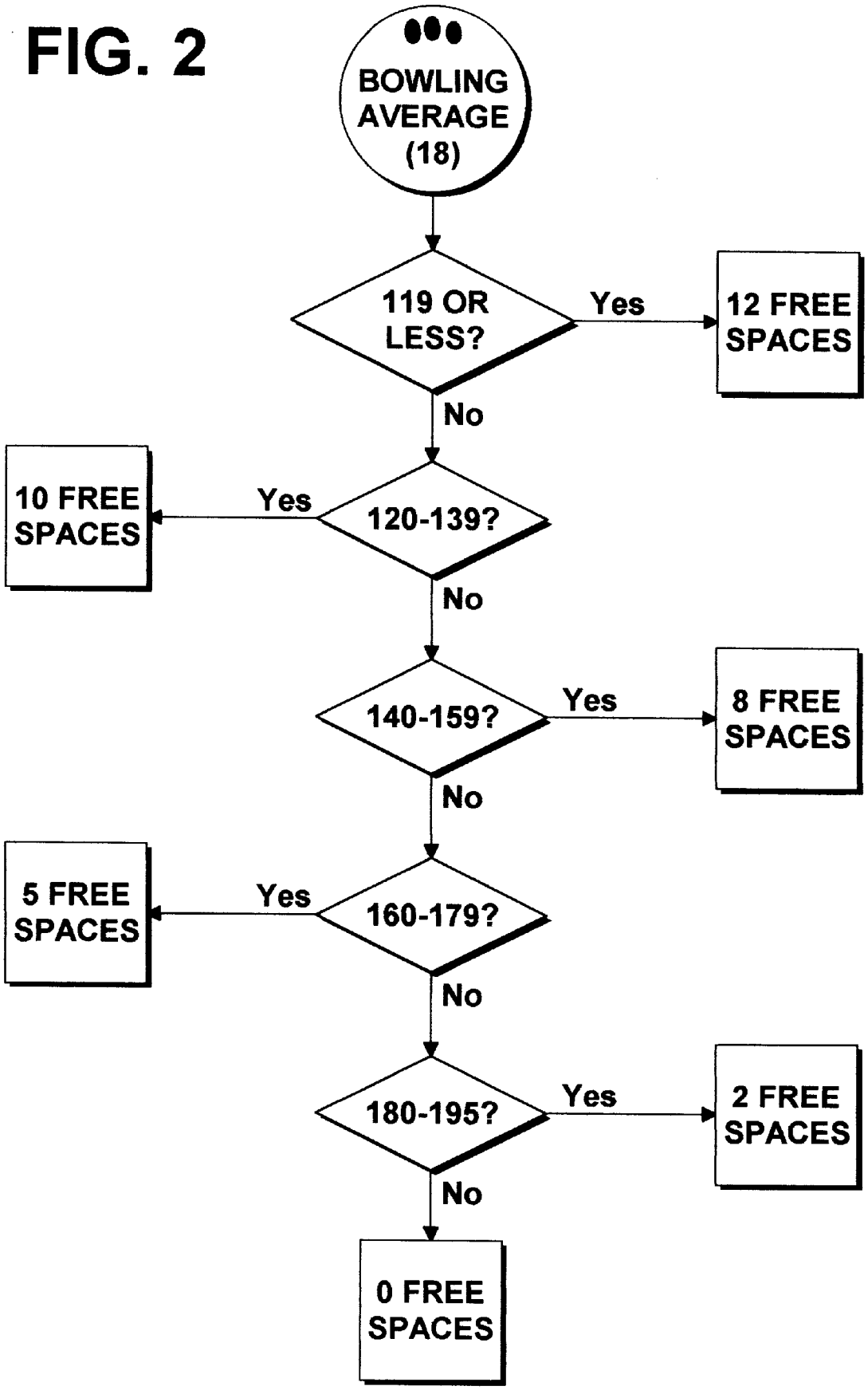
FIG. 2 is a process flow chart for determining the number of free spaces on the bingo card.

Determine by the game computer 44, a number 52 of differently located free spaces 54 on each different. bingo card 50, which as shown in FIG. 2 and summarized in FIG. 3, is dependent upon the pre-certified bowling league average 18 of the bowler 16 so as to equalize skill level of the bowler 16.

For example, the bowler 16 with a pre-certified bowling league average 18 of 196 or better, the highest skill level, is issued a bingo card 50 with 25 designated frames 56; the bowler 16 with a pre-certified bowling league average 18 between 180 and 195 is issued a bingo card 50 with 23 designated frames 56, the other 2 positions on the bingo card 50 being designated "free," and so on until the bowler 16 with a pre-certified bowling league average 18 of 119 or less, the lowest skill level, is issued a bingo card 50 with 13 designated frames 56, the other 12 positions on the bingo card 50 being designated "free."

STEP 5

Figure 4:
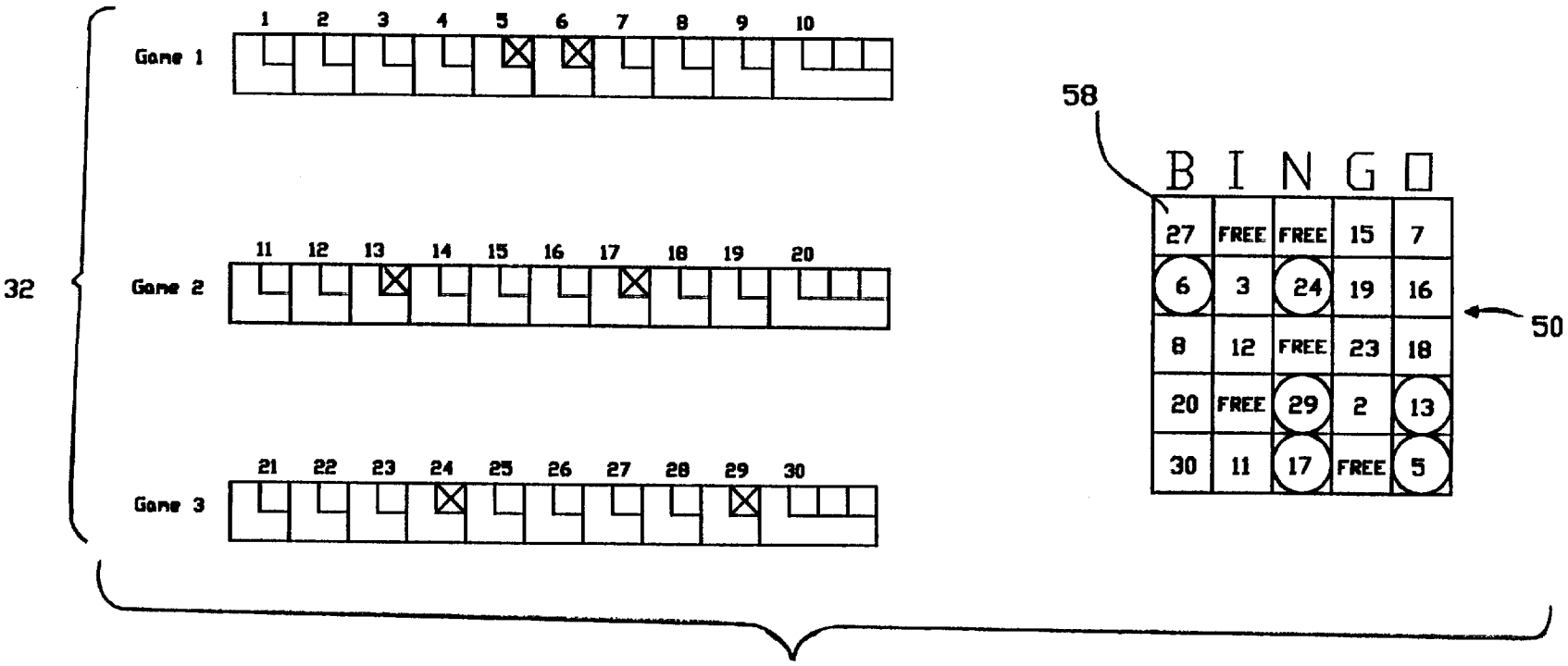
FIG. 4 is a pictorial diagram illustrating the spaces on the bingo card and their corresponding frame numbers.

Generate, by the game computer 44 the bingo card 50 containing 25 arbitrary numbers 58, from 1–30 of the three game league bowling session 32, in a 5×5 array 60. As shown in FIG. 4, the numbers 58 on each bingo card 50 correspond to the individual frame numbers that make up the three game league bowling session 32, namely, game no. 1 includes frames 1–10; game no. 2 includes frames 11–20; and game no. 3 includes frames 21–30. The 5×5 array 60 remains unamended throughout the three game league bowling session 32.

STEP 6

Generate a receipt 62 with the bowler's first and last name 46 under the title "bowling name" 64 thereon. The name used on the automatic scoring equipment 48 must match the name 46 on the receipt 62, and can be corrected on the automatic scoring equipment 48 only during the first game.

Bowlers who's names are not corrected before the end of the first game will be disqualified and forfeit any entered competitions.

STEP 7

Enter the bowler's first and last name 46 into automatic scoring equipment 48. To match the name as it appears in the game data base.

STEP 8

Begin play.

STEP 8A

Track by the game computer 44 bowler's performance 66, as reported on the automatic scoring equipment 48.

STEP 8B

Enter such performance 66 in the game data base 38.

STEP 8C

Store such performance 66 in the game data base 38.

STEP 9

Bowl a ball 68 by the bowler 16.

STEP 10

Determine if a strike 70 has been thrown.

STEP 11

Match strike frame number 72 to the array 60 on the bingo card 50, if answer to STEP 10 is yes.

STEP 12

Determine if the striked frame number 72 is on the bingo card 50.

STEP 13

Figure 5:
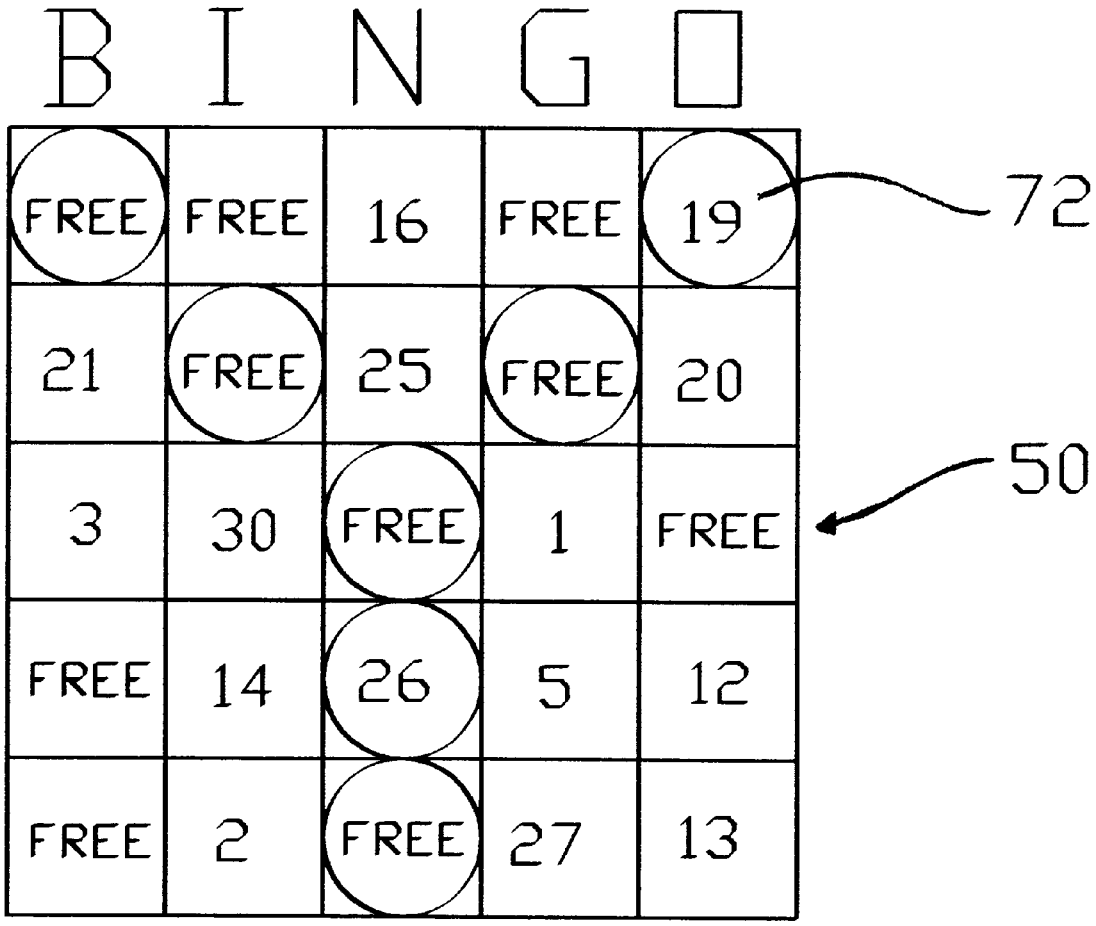
FIG. 5 is a pictorial diagram illustrating the circled spaces on the bingo card corresponding to striked frames and forming a winning pattern.

As shown in FIG. 5, mark the bingo card 50 by circling the strike frame number 72 thereon, if answer to STEP 12 is yes.

The making of the bingo cards is optional as the computer system performs this function internally to determine winners.

All tenth frame strikes for each game, i.e. frames marked 10, 20, and 30 are for the first ball bowled in each of those frames only.

STEP 14

Wait for next turn and return to STEP 9, if answer to either of STEPS 10 or 12 is no.

STEP 15

Determine at the end 74 of the three game league bowling session 32 if one pre-identified pattern 76 is completed so as to form a winning bingo card 78.

Figure 6A:
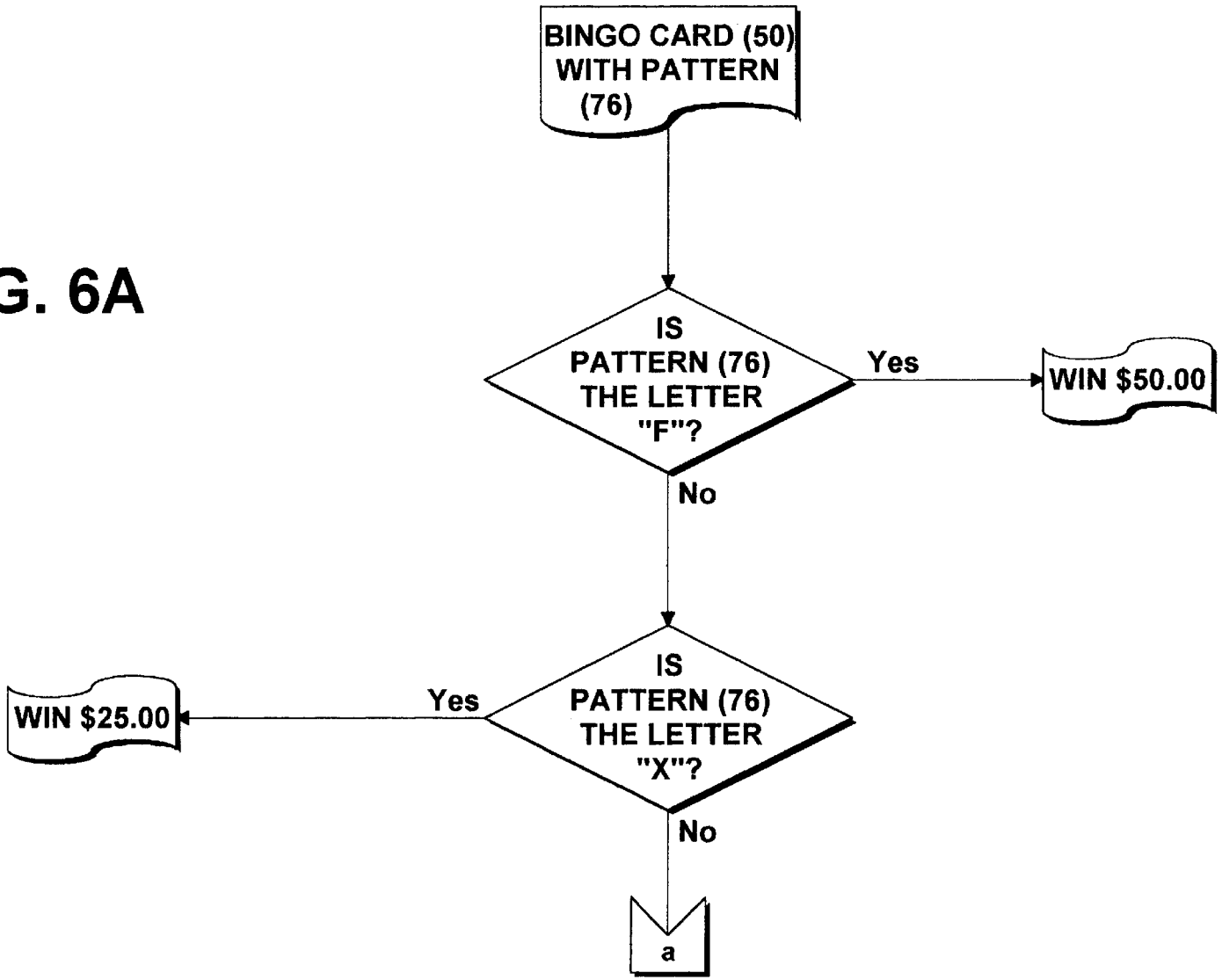
FIGS. 6A–6C are a process flow chart for determining the amount of winnings dependent upon the pattern completed on the bingo card.
Figure 6B:
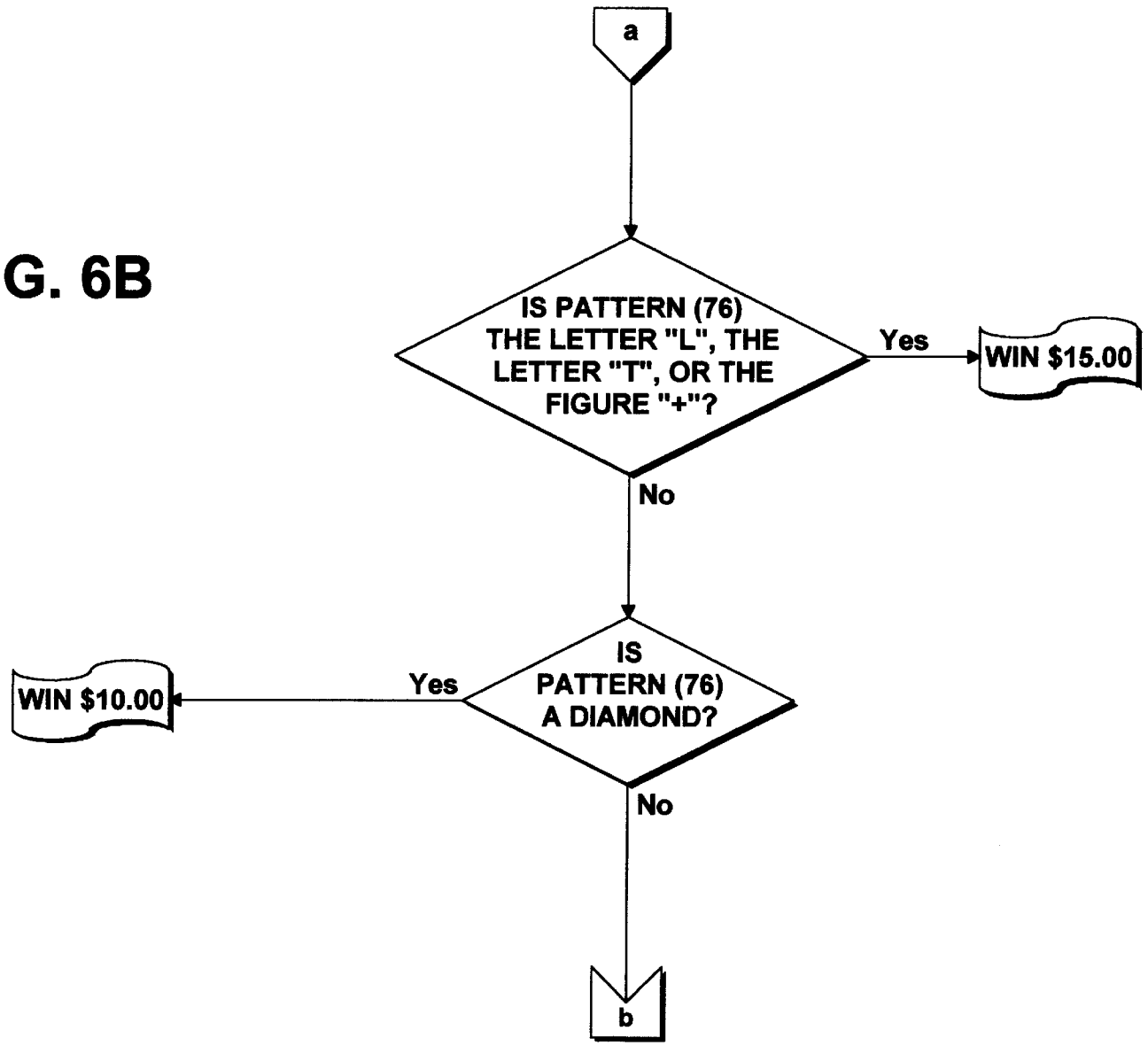
Figure 6C:
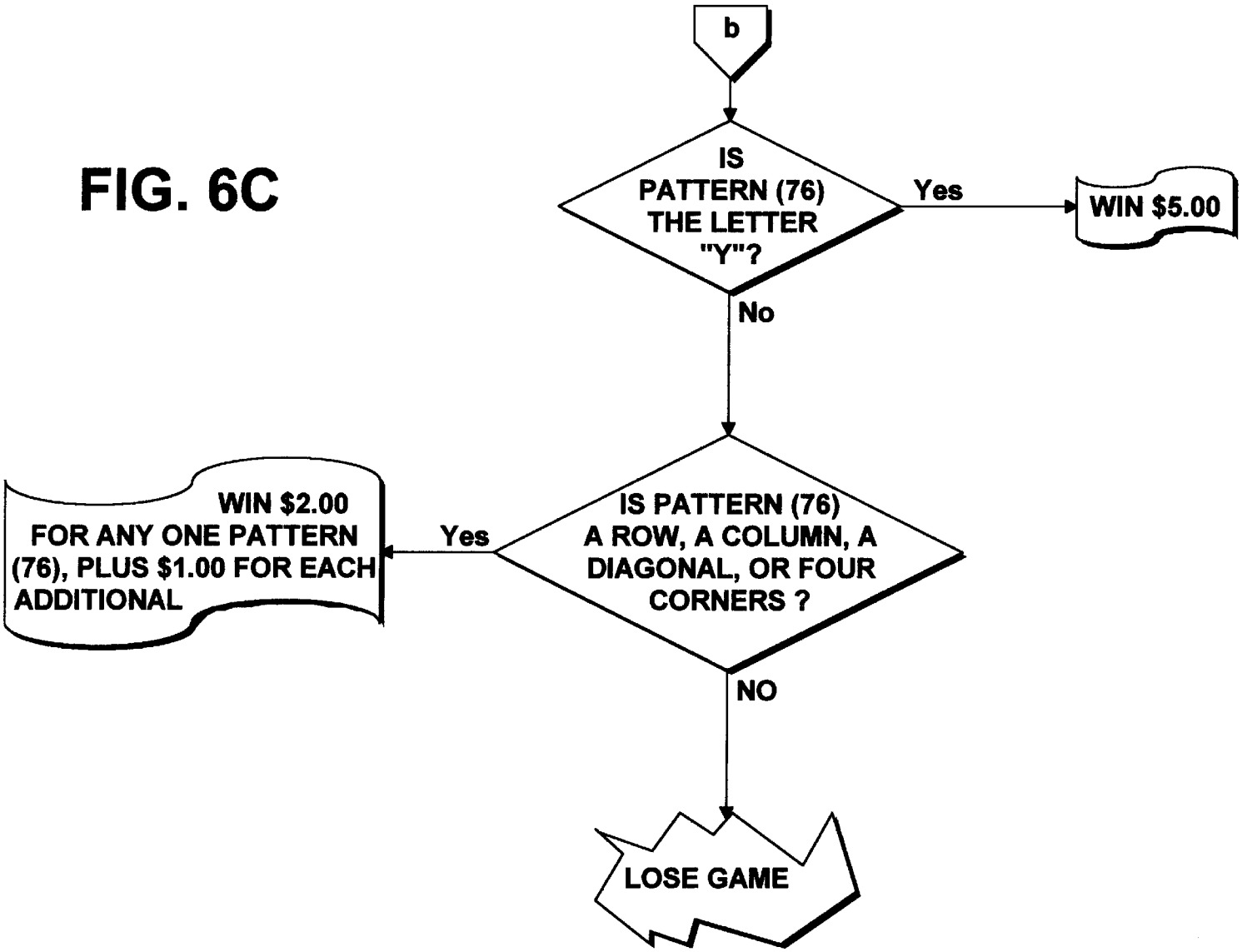
Figure 7:
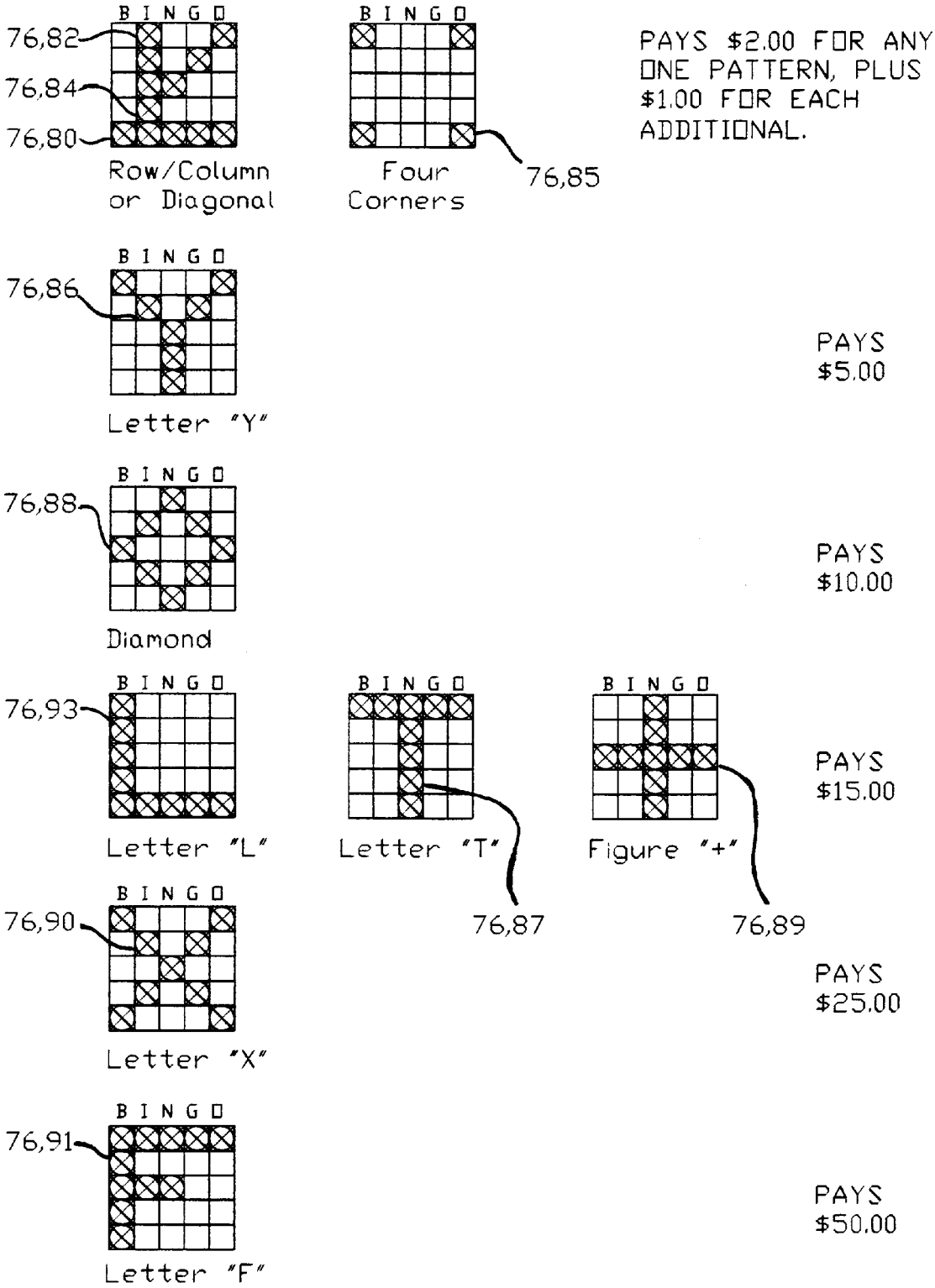
FIG. 7 is a pictorial diagram summarizing the results of FIG. 6.

For example, as shown in FIG. 6 and summarized in FIG. 7, the pre-identified pattern 76 can be a row 80, a column 82, a diagonal 84, four corners 85, the letter "Y" 86, a diamond 88, the letter "X" 90, the letter "L" 93, the letter "T" 87, the figure "+" 89, or the letter "F" 91.

STEP 16

Present the winning bingo card 78 and all other bingo cards 50 to the customer service counter personnel 12, if answer to STEP 15 is yes.

STEP 17

Enter the bowler's unique identification number 14 into the game data base 38.

STEP 18

Compare by the game computer 44 the bowler's performance 66 as stored in the game data base 38 with the array 60 on the bingo card 50.

STEP 19

Verify that reported performance 92 by the bowler 16 conforms to the bowler's performance 66 recorded in the game data base 38.

STEP 20

Lose game, if answer to either of STEPS 15 or 19 is no.

STEP 21

Win game, if answer to STEP 19 is yes, with the prize being dependent upon the difficulty of the pre-identified pattern 76 successfully completed.

Cumulative prize pay-outs for multiple winning bingo configurations on a single bingo, i.e. multiple lines, columns, etc., are only permitted in the lowest payout category.

Prize pay-outs are not be combined with other category winnings.

Prize pay-outs for bingo winnings beyond the lowest level category bingo configuration is made to the highest payout category achievement, i.e. a payout category won beyond the lowest bingo achievement coupled with one or several lowest category achievements will result in the highest category payout only.

It is to be understood that the algorithm is proprietary to applicant. The algorithm can be changed to incorporate different payout returns and average brackets as needed based upon statistical or other information inputs so as to provide flexibility in all areas, without departing in any way from the scope of the algorithm.

It will be understood that each of the elements described above, or two or more together, may also find a useful application in other types of constructions differing from the types described above.

While the invention has been illustrated and described as embodied in a game method for enhancing the entertainment of a traditional bowling game, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

Various modifications and changes have been disclosed herein, and others will be apparent to those skilled in this art. Therefore, it is to be understood that the present disclosure is by way of illustration and not limiting of the present invention.

What is claimed is:

1. A game method for enhancing the entertainment of a traditional bowling game for a bowler bowling a three-game league bowling session on an assigned lane having automatic scoring equipment, said game method comprising the steps of:

a) providing scoring means having a plurality of numbered frames and a numbered bingo card;

b) having a bowler throw a ball to begin play;

c) determining if a strike has been thrown;

d) matching the frame number to an array on the bingo card, if answer to said first determining step is yes;

e) determining if the frame number is on the bingo card;

f) marking the frame number thereon, if answer to said second determining step is yes;

g) waiting for next turn and returning to said bowling step, if answer to said second determining step is no;

h) determining at the end of the three game league bowling session, if one pre-identified pattern is completed on the bingo card so as to form a winning bingo card;

i) losing game, if answer to said third determining step is no; and j) winning game, if answer to said third determining step is yes.

2. The game method as defined in claim 1, further comprising the step of providing to customer service counter personnel a unique identification number of the bowler with a pre-certified league bowling average.

3. The game method as defined in claim 2, wherein the unique identification number of the bowler includes: the initials of the bowler, the last four digits of the bowlers phone number, and the assigned lane number for the three game league bowling session.

4. The game method as defined in claim 2, further comprising the step of calculating the pre-certified league bowling average of the bowler as being one of last year's highest bowling average, with a minimum of 21 games, and the current year's highest league average of all leagues, with a minimum of 21 games.

5. The game method as defined in claim 2, further comprising the step of entering the bowler's unique identification number into a game data base in a game computer.

6. The game method as defined in claim 5, further comprising the step of determining, by the game computer, a number of differently located free spaces on each bingo card.

7. The game method as defined in claim 6, wherein the number of differently located free spaces on each bingo card is dependent upon the pre-certified bowling league average of the bowler so as to equalize skill level of the bowler.

8. The game method as defined in claim 6, wherein the number of differently located free spaces on each bingo card is zero for the bowler with the pre-certified bowling league average of at least 196 which is the highest skill level, the bowler with the pre-certified bowling league average between 180 and 195 is two, the bowler with the pre-certified bowling league average between 160 and 179 is five, the bowler with the pre-certified bowling league average between 140 and 159 is eight, the bowler with the pre-certified bowling league average between 120 and 139 is ten, and the bowler with the pre-certified bowling league average of no more than 119 which is the lowest skill level is twelve.

9. The game method as defined in claim 5, further comprising the step of generating, by the game computer, the bingo card containing 25 arbitrary numbers from 1–30 in a 5×5 array.

10. The game method as defined in claim 9, wherein the 25 arbitrary numbers from 1–30 correspond to the individual frame numbers that make up the three game league bowling session.

11. The game method as defined in claim 5, further comprising the step of entering the bowler's unique identification number into the game data base in the game computer again.

12. The game method as defined in claim 1, further comprising the step of entering the bowler's first and last name into an automatic scoring equipment and a most difficult average level when the bowler is uncertified.

13. The game method as defined in claim 12, further comprising the step of tracking, by the game computer, bowler's performance, as reported on the automatic scoring equipment.

14. The game method as defined in claim 13, further comprising the step of entering such performance in the game data base.

15. The game method as defined in claim 14, further comprising the step of storing such performance in the game data base.

16. The game method as defined in claim 15, further comprising the step of comparing by the game computer the bowler's performance as stored in the game data base with the array on the bingo card.

17. The game method as defined in claim 15, further comprising the step of verifying that reported performance by the bowler conforms to the bowler's performance recorded in the game data base.

18. The game method as defined in claim 1, further comprising the step of paying an entry fee for each bingo card of a number of different bingo cards desired.

19. The game method as defined in claim 18, wherein the number of bingo cards is a maximum of five bingo cards.

20. The game method as defined in claim 1, wherein the array on the bingo card remains the same throughout the three game league bowling session.

21. The game method as defined in claim 1, further comprising the step of generating a receipt with the bowler's first and last name under a title bowling name indicia thereon.

22. The game method as defined in claim 21, wherein the name under the title bowling name indicia on the receipt must match the name used on the automatic scoring equipment, and if not, is corrected on the automatic scoring equipment only during the first game, and if not, the bowler is disqualified and forfeits any entered competitions.

23. The game method as defined in claim 1, said marking step includes circling the strike frame.

24. The game method as defined in claim 1, wherein said marking step includes marking all tenth frame strikes for a first ball bowled in each of those frames only.

25. The game method as defined in claim 1, wherein the pre-identified pattern is at least one of a row, a column, a diagonal, four corners, the letter "Y", the letter "T", a diamond, the figure "+", the letter "X", the letter "F", and the letter "L".

26. The game method as defined in claim 1, further comprising the steps of presenting the winning bingo card and all other bingo cards to the customer service counter personnel, if answer to said third determining step is yes.

27. The game method as defined in claim 1, wherein said winning step includes winning a prize that is dependent upon the difficulty of the pre-identified pattern successfully completed.

* * * * *